US007950312B2

(12) United States Patent
Matthiesen et al.

(10) Patent No.: US 7,950,312 B2
(45) Date of Patent: May 31, 2011

(54) FASTENING ELEMENT FEEDING DEVICE FOR POWER DRIVE-IN TOOL

(75) Inventors: Sven Matthiesen, Lindau (DE); Marco Zurkirchen, Bubikon (CH); Marcel Koelliker, Kuesnacht (CH)

(73) Assignee: Hilti Aktiengesellschaft, Schaan (LI)

( * ) Notice: Subject to any disclaimer, the term of this patent is extended or adjusted under 35 U.S.C. 154(b) by 1211 days.

(21) Appl. No.: 11/595,438

(22) Filed: Nov. 8, 2006

(65) Prior Publication Data

US 2007/0102440 A1 May 10, 2007

(30) Foreign Application Priority Data

Nov. 9, 2005 (DE) ..... 10 2005 000 150

(51) Int. Cl.
*B25B 23/04* (2006.01)

(52) U.S. Cl. ..... 81/434; 81/57.37

(58) Field of Classification Search ..... 81/434, 81/433, 57.37
See application file for complete search history.

(56) References Cited

U.S. PATENT DOCUMENTS 4,428,261 A * 1/1984 Takatsu et al. ..... 81/434
5,144,870 A * 9/1992 Nick ..... 81/434
5,402,695 A * 4/1995 Hornung ..... 81/434
5,671,645 A * 9/1997 Murayama et al. ..... 81/434
5,988,025 A * 11/1999 Sasaki et al. ..... 81/434
6,138,535 A * 10/2000 Jalbert et al. ..... 81/434
6,138,536 A * 10/2000 Chen ..... 81/434
6,676,001 B1 * 1/2004 Chen et al. ..... 227/119
6,915,724 B2 * 7/2005 Kigel et al. ..... 81/434
7,493,839 B2 * 2/2009 Massari et al. ..... 81/434
2004/0123704 A1 * 7/2004 Kigel et al. ..... 81/434
2006/0053978 A1 * 3/2006 Arai ..... 81/57.37
2006/0191385 A1 * 8/2006 Massari et al. ..... 81/434

* cited by examiner

*Primary Examiner* — David B Thomas
(74) *Attorney, Agent, or Firm* — Abelman, Frayne & Schwab

(57) ABSTRACT

A fastening element feeding device for a power drive-in tool includes a transportation device (30) having a transportation wheel (32) for a magazine strip (50), at least one actuation member (35) displaceable in a control track (16) in a first component (11) for effecting a relative displacement between the first component (11) and the second component (21), which results in a transportation displacement of the transportation wheel (32); a displacing member (31) having one end region (39) which is adjacent to the head (22), supporting the rotary axle (D) together with the transportation wheel (32), and having another of its end regions (38) supporting the at least one actuation member (35); and a guide arrangement that provides for displacement of the displacing member (31) over the second component (21).

7 Claims, 6 Drawing Sheets

FASTENING ELEMENT FEEDING DEVICE FOR POWER DRIVE-IN TOOL

BACKGROUND OF THE INVENTION

1. Field of the Invention

The present invention relates to a fastening element feeding device for a power drive-in tool and which includes a first component connectable with the power drive-in tool and a second component displaceably supported on the first component and having a head applicable against a constructional component, and a transportation device for feeding fastening elements arranged in a magazine strip in a drive-in channel. The transportation device includes a transportation wheel for the magazine strip and rotatably supported on a rotary axle, at least one actuation member displaceable in a control track in a first component for effecting a relative displacement between the first component and the second component which results in a transportation displacement of the transportation wheel.

2. Description of the Prior Art

Fastening element feeding devices for power drive-in tools such as, e.g., screwdriving power tools have a head that is placed on a constructional component and serves for guiding fastening elements such as, e.g., screws before and during a setting process. The head can be formed, e.g., as a part of a magazine with fastening elements or of a fastening element transportation device that is mountable on a flange of a drive-in tool.

German Utility Model DE 203 09 492 U1 discloses a screwdriving power tool with a screw feeding device having a first component in form of a holder that is mounted on a flange of the tool housing. A second component of the screwdriving tool in form of a screw guide is arranged on the first component with a possibility of displacement relative thereto, with the end of the screw guide, which faces in the operational direction, being placeable against a constructional component. On the second component, there is provided a rotatable disc on which a pawl is arranged. The pawl has an arm that projects from the rotatable disc and has a fixation pin on its end remote from the disc. The fixation pin extends through curved opening in a drive block and extends through a guideway in the holder. When the screw guide is displaced, upon the screwdriving tool being pressed against a constructional component, into the holder, the fixation pin is displaced along the guideway, with the pawl being rotated by the arcuate curved opening in the drive block. Thereby, the screws are fed through the screw guide and toward the screwdriving working tool.

The drawback of the above-described feeding device consists in the arrangement of the curve guide that curves with respect to the rotating disc and extends substantially transverse to the operational axis which is defined by the screwdriving working tool, which unfavorably influences the kinematics of the transport mechanism and leads to jamming and soiling of the curved guide. In addition, for starting the press-on process, a high press-on force, which is applied by the user, is needed for transportation of the screws.

German Publication DE 25 41 046 A1 discloses a power tool for screwing screws in, in which a slide is displaceably supported in the tool housing. In the slide, there is arranged a device for a stepwise transportation of screws in a screw-in position. The transportation device includes a ratchet wheel with two ratchet discs and a clutch disc. The clutch disc has projections that engage in corresponding recesses in the ratchet disc and are retained there by a biasing force. On the clutch disc, there is further provided a pin displaceable in a guide slot in the tool housing and in a slot in the slide. Upon the front end of the slide being pressed against a workpiece, the pin and the clutch disc connected therewith are rotated in the clockwise direction as a result of the positive guidance. This causes displacement of the strip with screws and feeding of a screw to the screw-in position. Upon lifting of the slide off the constructional component, the pin is displaced in the opposite direction, with a pawl preventing rotation of the ratchet discs in the counterclockwise direction. As a result, the clutch disc with the projections disengages from the ratchet disc against a spring biasing force and displaces alone in the counterclockwise direction to its initial position.

The drawback here, as in the German Utility Model DE 203 09 492 U1, consists in that for starting the press-on process, a high press-on force, which is applied by the user, is needed for transportation of the screws. Also, the transportation mechanism is susceptible to soiling and the resulting therefrom, failures.

German Patent DE 42 19 095 C1 discloses a displacement device with a ratchet wheel for a drive-in tool in which the ratchet wheel is supported on an end of a first arm of a two-arm pivotal lever, with the control pin being supported on the second arm. The two-arm pivotal lever in supported on a drag bearing arranged between the first and second arms. Upon a stop of the slide being pressed against a workpiece, the pivotal lever pivots, as a result of a positive guidance, in the clockwise direction, together with the ratchet wheel. The ratchet wheel is stopped by a stop catch and does not pivot further but still transports further screw strip. Upon the drive-in tool being lifted off the workpiece, the slide is pushed out of the housing by a spring, and the positively guided pin pivots the pivotal lever in the counterclockwise direction, with the rungs of the ratchet wheel still engaging in rim recesses of the screw strip.

The drawback of the displacement device of the German Patent consists in that the pivotal lever is very sensitive to soiling which can adversely affect its function.

Accordingly an object of the present invention is to provide a fastening element feeding device for a power drive-in tool in which the drawbacks of the known feeding devices are eliminated.

Another object of the present invention is a fastening element feeding device for a power drive-in tool and which has a simplified construction and provides for a reliable transportation of the screw strip.

SUMMARY OF THE INVENTION

These and other objects of the present invention, which will become apparent hereinafter, are achieved by providing a fastening element feeding device of the type described above in which the transportation device has a displacing member having one of its end regions, which is adjacent to the head, supporting the rotary axle together with the transportation wheel and having its another end region supporting the at least one actuation member, and has a guide means providing for displacement of the displacing member over the second component. Advantageously, the displacing member is displaced along a curved track. Upon the drive-in tool being pressed against a constructional component, the transportation wheel, together with the displacing member, is displaced in the transportation direction of the strip, whereby because of guidance of the displacing member, no danger of jamming, as a result of soiling, exists even during displacement to the initial position. These measures also permitted to obtain a technically simple, easily manufacturable and reliably operating transportation mechanism.

Advantageously, the guide means has at least one first guide curve and at least one second guide curve both provided on the second component and first and second control pins displaceable along the first and second guide curves respectively. The first and second guide curve are spaced from each other in a direction of an operational axis defined by the drive-in channel and have each a first end adjacent to the operational axis and a second end remote from the operational axis. These measures provide separate guides for the front and rear ends of the displacing member. The virtual rotational axes, which the guide curves produce and which are relevant for the transportation of the fastening elements, are located outside of the housing, with their position changing, whereby the press-on force necessary for the transportation of the strip in accordance with the press-on path, is optimized. In addition, the displacement path can be optimally adapted to the transportation of the strip.

It is further advantageous, when the first control pin is formed coaxially with the actuation member and the second control pin lies concentrically with the rotary axle of the transportation wheel. This insures a compact construction. The first control pin is located in the initial position of the transportation device, preferably, at the first end of the first guide curve, which is located adjacent to the operational axis, whereas the second control pin is located in the initial position at the end of the second guide curve, which is remote from the operational axis. This insures a definite position of the displacing member. Advantageously, the first guide curve has a curvature that curves away from the operational axis between its adjacent and remote ends and the second guide curve has a curvature that curves toward the operational axis between its remote and adjacent ends. Thereby the front end of the displacing member, adjacent to the head performs a different curved movement than the rear end of the displacing member. This increases the resistance of the transportation device to tilting during a return movement.

Advantageously, the transportation wheel has two, spaced from each other along the rotary axle, ratchet discs, and the device further comprises two ratchet mechanisms associated with respective ratchet discs which provide for a separate control of the two ratchet discs.

Advantageously, there is provided return means associated with the first ratchet disc. The first ratchet mechanism is located between the return means and the first ratchet disc, the device further includes control means for controlling the return means so that rolling of the transportation wheel over the magazine strip is possible only in a return direction of the transportation device. Thereby, an additional locking device for stopping the magazine strip is not any more necessary, which permits to reduce costs. The magazine strip, thus, is reliably held by the transportation wheel at each point in time. According to a constructively simple solution, the control means includes at least one control curve provided on the second component and at least one control member arranged on a control plate and displaceable over the control curve. The first ratchet mechanism includes spring means secured on the control plate.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
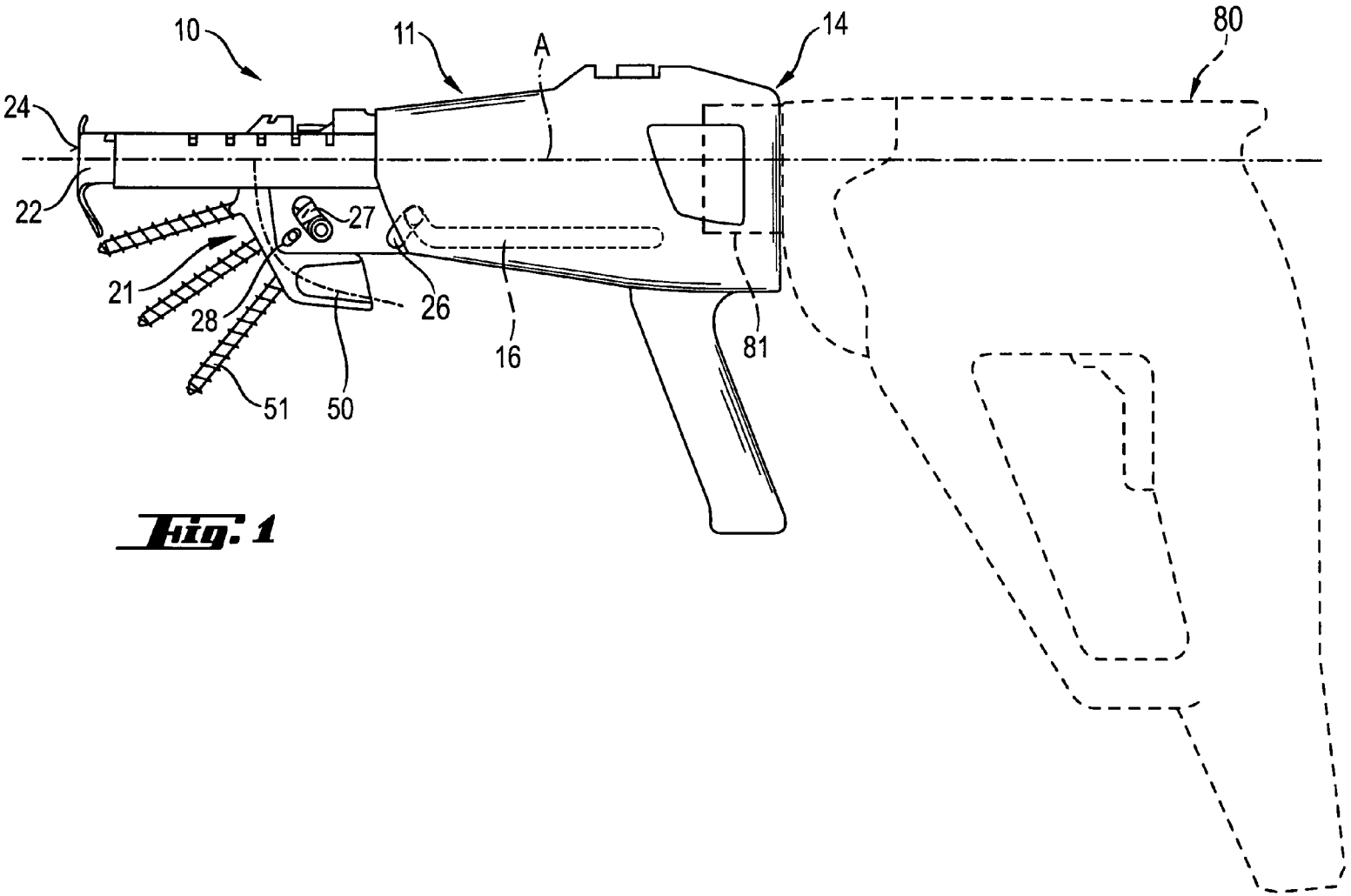
FIG. 1 a side view of a fastening element feeding device according to the present invention and which is mounted on a drive-in tool.
Figure 2:
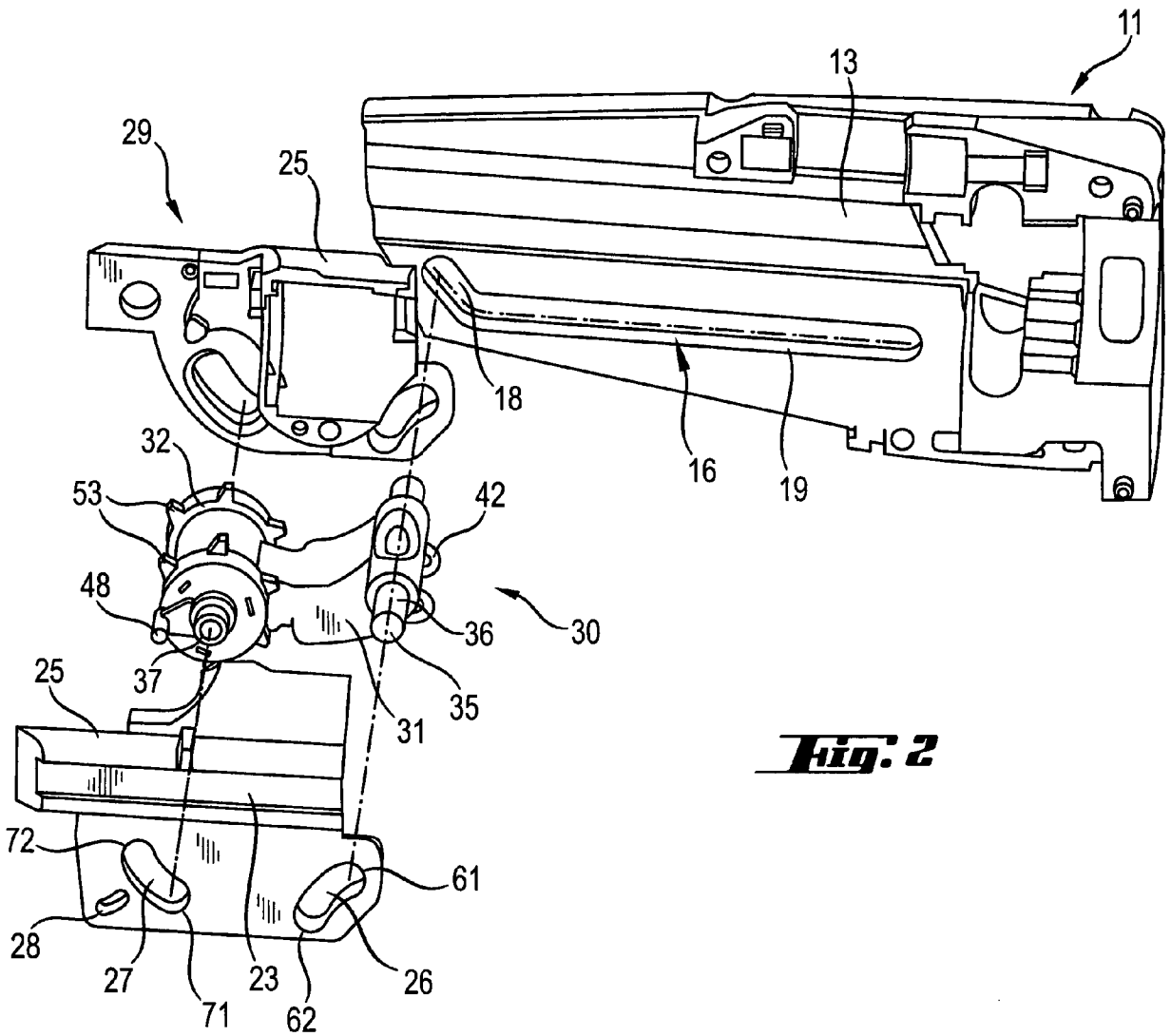
FIG. 2 an exploded view of a detail of the fastening element feeding device shown in FIG. 1.
Figure 3:
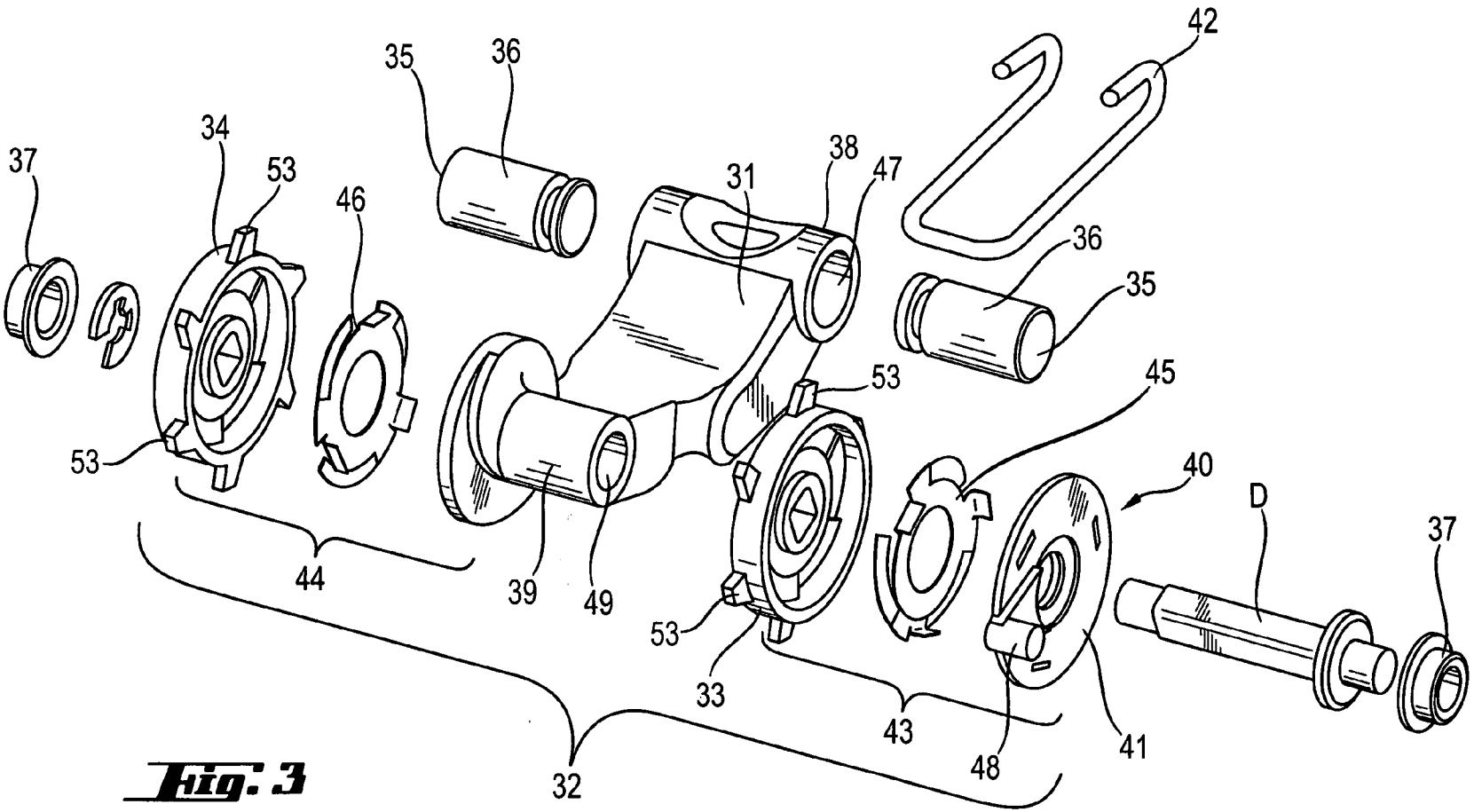
FIG. 3 an exploded view of a further detail of the fastening element feeding device shown in FIG. 1.
Figure 4:
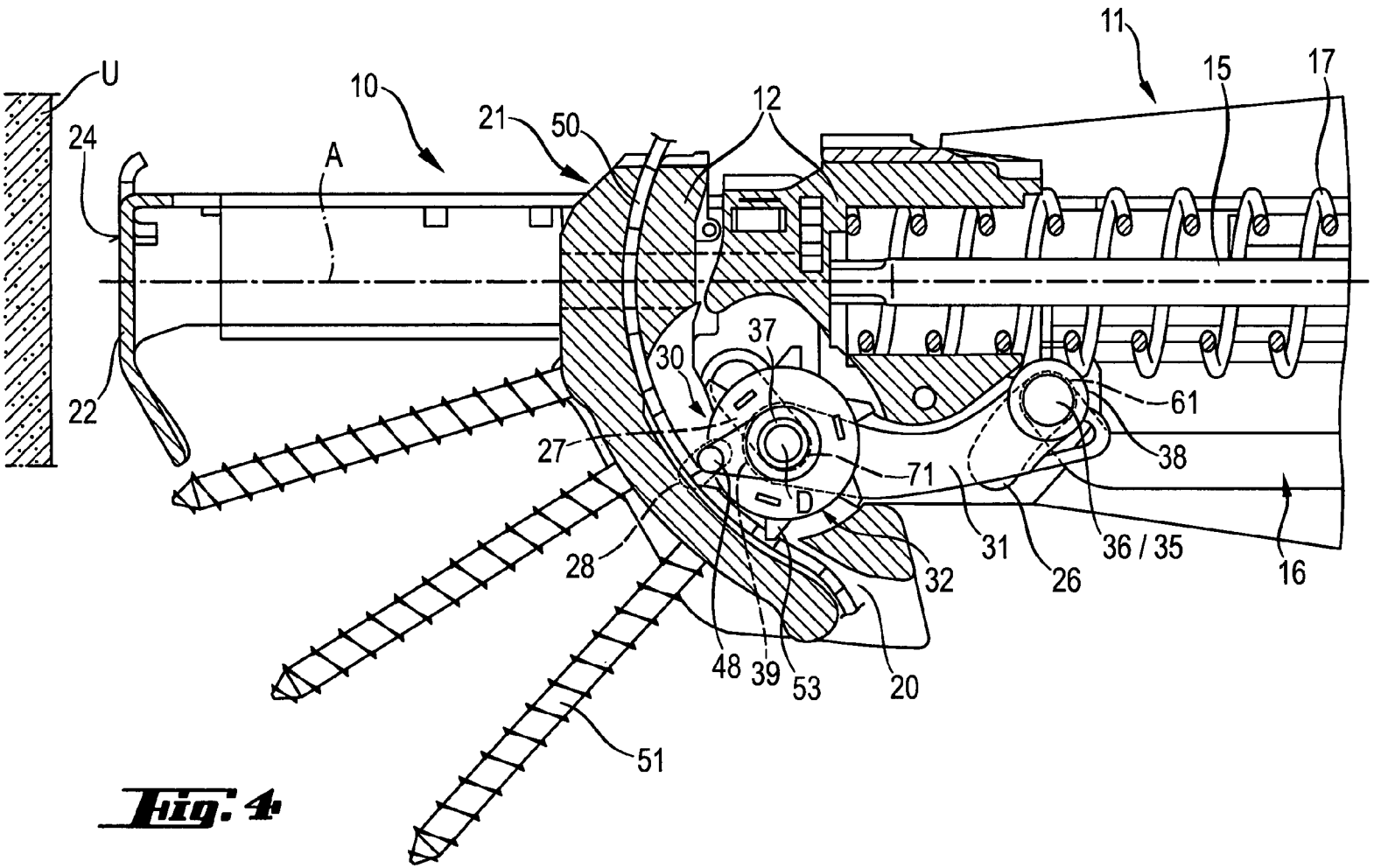
FIG. 4 a cross-sectional view of the fastening element feeding device shown in FIG. 1 in an initial position thereof.

FIGS. 1-6 show a fastening element feeding device according to the present invention which is generally designated with a reference numeral 10 and is releasably mounted with a coupling section 14 on a flange 81 of a hand-held power drive-in tool 80 shown only schematically, with dash lines, in FIG. 1. The drive-in tool 80 is formed here as an electrically driven screwdriving tool.

The fastening element feeding device 10 is formed as a screw-containing magazine with an integrated transportation device 30 for transporting a magazine strip 50. In the fastening element feeding device 10, a drive-in working tool 15, which is formed as a screwdriving working tool, is displaceable in a drive-in channel 12 and is rotationally driven by the power drive-in tool 80. With the transportation device 30, in a single step, upon the tool 80 being pressed with the fastening element feeding device 10 against a constructional component U, a fastening element 51 is displaced into the drive-in channel 12 in front of the drive-in working and tool 15 to be subsequently driven in the constructional component U with the drive-in tool 15. The drive-in channel 12 defines an operational axis A of the fastening element feeding device 10.

The fastening element feeding device 10 includes a first component 11 that contains the coupling section 14 and is formed as a guide housing, and a second component 21 displaceably supported on the first component 11. The second component 21 is supported against the first component 11 by an elastic return member 17. The second component 21 is formed as a slide and has two guide sections 23 which are axially displaceable in guides 13 provided on the first component 11. The second component 21 carries the transportation device 30 and displaces the magazine strip 50 with fastening elements 51 in a strip guide 20. The second component 21 has a head 22 which can abut the constructional component U with its end surface 24. The head 22 is spaced from a support 29 having two side support members 25 between which a displacing member 31 of the transportation device 10 is displaceably supported, as particularly shown in FIG. 3. The distance between the head 22 and the support 29 is adjusted by a mechanism, not shown in the drawings, in order to be able to use fastening elements having different lengths.

As particularly shown in FIGS. 2 through 6, the displacing member 31 of the transportation device 30 has a curved or bent profile and carries, at its first end or end region 38 adjacent to the coupling section 14, two first control pins 36.

The first control pins 36 are displaceably arranged in a receptacle 47 in which they are supported against each other by a spring 42. The first control pins 36 extend through respective first guide curves 26 along which they are displaced. The control pins 36 forms, at their ends remote from the receptacle 47, respective actuation members 35 extending into respective guide curves 16 in the first component 11 and displaceable therein.

At a second end region 39 or an end opposite the first end region 38 of the displacing member 31, a transportation wheel 32 is rotatably supported on a rotary axle D displaceable in a bearing bush 49. At both opposite ends of the rotary axle D, there are formed second control pins 37 displaceable in respective guide curves 27 of the support 29 on the second component 21.

The first guide curve 26 has a curvature that bends away from the operational axis between an end 61 adjacent to the operational axis A and remote from the head 22 and an end 62 remote from the operational axis A and adjacent to the head 22. The second guide curve 27 has a curvature that curves toward the operational axis A between an end 71 remote from the operational axis A and from the head 22 and an end 72 adjacent to the operational axis A and the head 22. The curvatures of both first and second guide curves 26 and 27 are shown in FIGS. 2, 4, 5 and 6. The specific arrangement of the first and second guide curves 26 and 27 prevents tilting of the displacing member 31 that is guided by the control pins 36 and 37 along the guide curves 26, 27.

The transportation wheel 32 has first and second ratchet discs 33 and 34 and a return member 40 that cooperates with the first ratchet disc 33. A ratchet mechanism 43, 44 is associated with a respective one of the ratchet discs 33, 34. The ratchet mechanism 43, 44 each has a spring 45, 46. The step-forming rungs 53, which are formed on the ratchet discs 33, 34, engage in transportation openings provided in the magazine strip 50 that is located in the strip guide 20 in the second component 21.

The return member 40 has a control plate 41 on which a control member 48 in form of a pin is formed. The control member 48 engages in a control curve 28 of a support member 25 of the support 29 of the second component 21 (FIGS. 2 through 6).

In the initial position of the fastening element feeding device 10, which is shown in FIGS. 1-4, the second component 21 is spaced from the first component 11 to a most possible extent by the biasing force of the return member 17 which is formed, e.g., as a spiral spring. The first control pins 36 are located at the first ends 61 of the first guide curves 26, and the second control pins 37 are located at the first ends 71 of the second guide curves 27. The transportation wheel 32 engages with its rungs 53 in the transportation openings in the magazine strip 50 in the strip guide 20.

Figure 5:
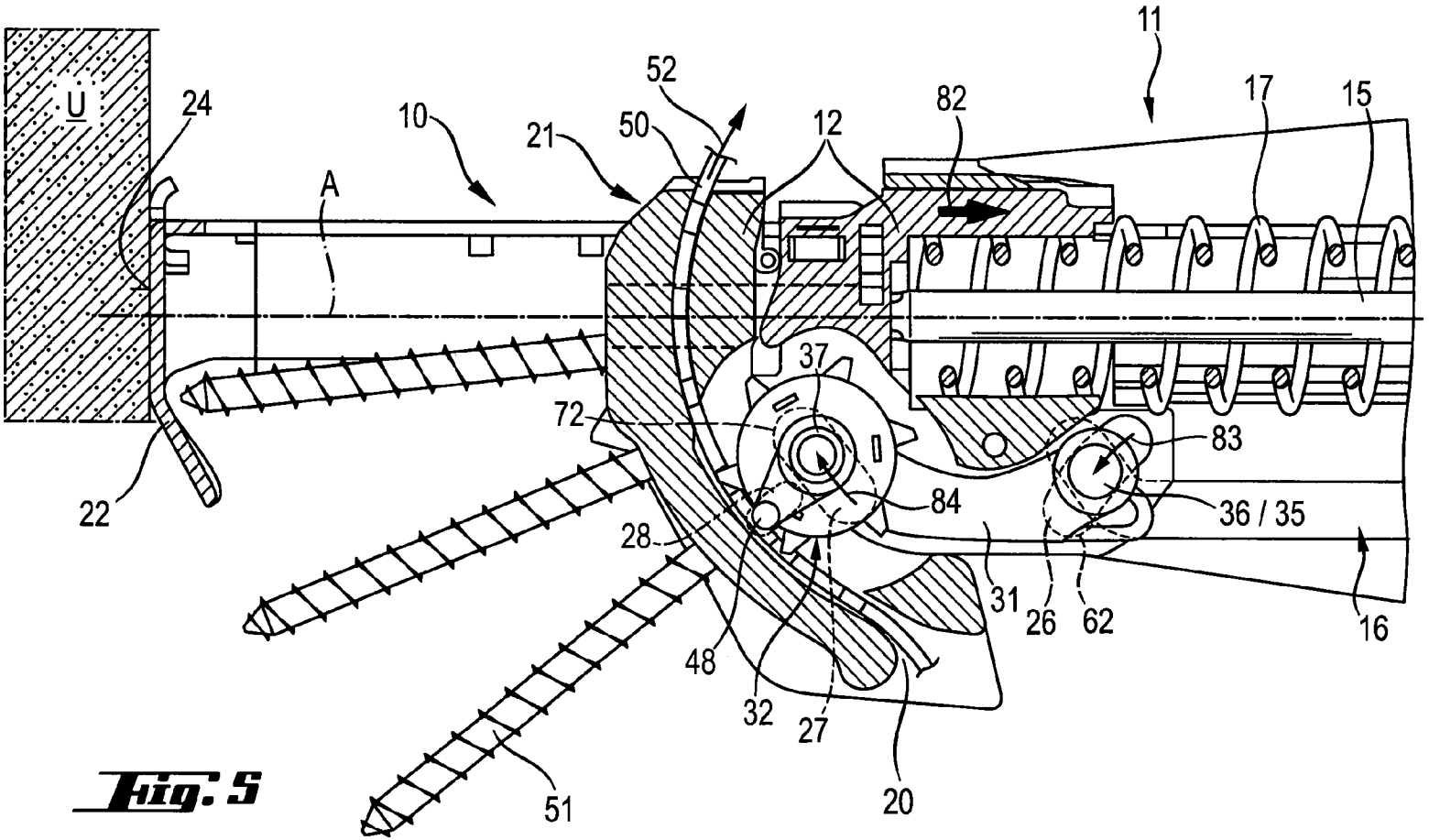
FIG. 5 a cross-sectional view of the fastening element feeding device shown in FIG. 2 in a position in which the drive-in tool is partially pressed against a constructional component.

With the drive-in tool 40 being pressed with the arranged thereon, fastening element feeding device against a constructional component U, as shown in FIG. 5, the second component 21 is displaced inward into the first component 11 in direction of arrow 32. As a result of this movement, the actuation members 35 are displaced in the first sections 18 of the control tracks 16 in a direction away from the operational axis A.

Thereby, the control pins 36, which are associated with the control members 35, are displaced in the direction of arrow 83 toward the second ends 62 of the first control curves 26, and the rear first end region 38 of the displacing member 31 is displaced away form the operational axis A. The front second region 39 of the displacing member 31 is controlled separately by the control pins 37 engaging in the second guide grooves 27 and is displaced by the control pins 37 in the direction of the arrow 84 and toward the operational axis A, with the second control pins 37 movable toward the second ends 72 of the second guide curves 27. The transportation wheel 32 with both ratchet discs 33, 34 would also move, as a result of the displacement of the displacing member 31, in the direction of the arrow 84 toward the operational axis A. The second ratchet disc 34 is stopped by the second ratchet mechanism 44 and its spring 46, so that the magazine strip 50 is displaced by then non-rotatable transportation wheel 32 in the direction of arrow 52.

Figure 6:
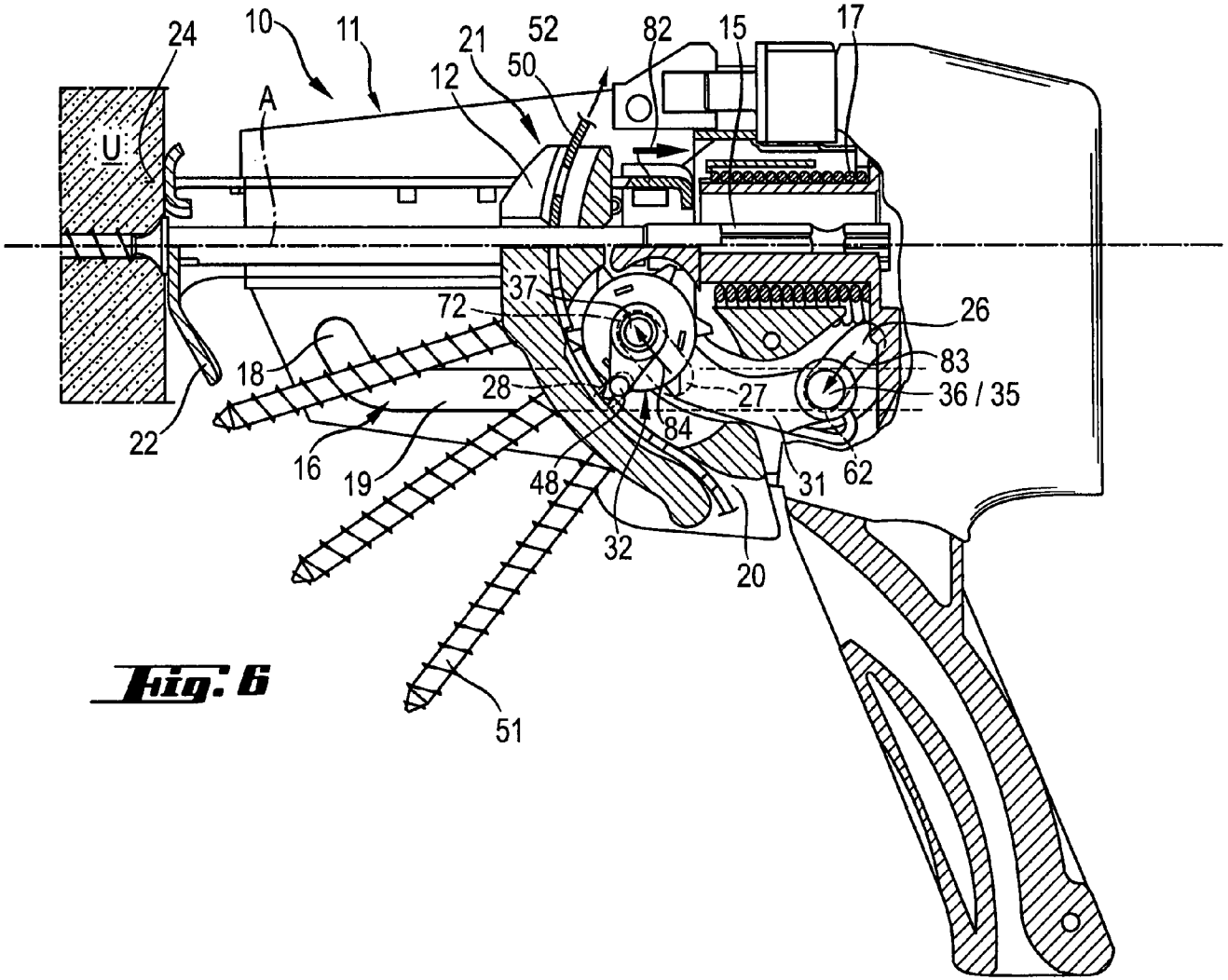
FIG. 6 a cross-sectional view of the fastening element feeding device shown in FIG. 2 in a position in which the drive-in tool is completely pressed against the constructional component.

In FIG. 6, the magazine strip 50 has been transported by the transportation device 30 by a whole step, with a fastening element 51 being displaced in drive-in channel 12 for being driven with the drive-in working tool 15 in the constructional component U. The displacing member 31 would be displaced with the transportation wheel 32 in the above-described manner until the first and second control pins 36, 37 reach the second ends 62, 72 of the control curves 26, 27. The actuation members 35 are displaced further, after the displacing member 31 reached its end position, in the second sections 19 of the control curves 16 that extend in the direction of the operational axis A.

After the drive-in or screw-in process has ended, upon lifting of the drive-in tool 80 and the fastening element feeding device 10 off the constructional component U, the second component 21 is pushed out of the first component 11 under action of the biasing force of the return member 17. Thereby, the actuation members 35 are displaced along the second sections 19 of the control curves 16. As soon as actuation members 35 are displaced in the first sections 18 of the control curves 16, the first and second control pins 36, 37 are displaced in the first and second guide curves 26, 27 in the direction opposite the direction of arrows 83, 84 from the second ends 62, 72 of the first and second guide curves 26, 27 toward the first ends 61, 71. The displacing member 31, together with the transportation wheel 32, is displaced thereby in the corresponding directions. During this return movement, the transportation wheel 32 rolls over the magazine strip 50. The rolling over is controlled by the control member 40, the control member 48 of which is displaced in the control curve 28. The control plate 41 of the control member 40 is stopped upon the return movement of the displacing member 31 by the ratchet mechanism 43 and its spring 45, on the first ratchet disc 33. The second ratchet disc 34 continues to rotate and overrattles a position. The transportation device 30 and the fastening element feeding device 10 are again in the initial position with the active rolling-over of the transportation wheel 32 along the magazine strip 50, the fastening element feeding device 10 need not be fixed in its position additionally by a locking device.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A fastening element feeding device for a power drive-in tool, comprising a first component (11) connectable with the power drive-in tool (80); and a second component (21) displaceably supported on the first component (11) and having a head (22) placeable on a constructional component (U), and a transportation device (30) for feeding fastening elements (51) arranged in a magazine strip (50) in a drive-in channel (12), the transportation device (30) including a transportation wheel (32) for the magazine strip (50) and rotatably supported on a rotary axle (D), at least one actuation member (35) displaceable in a control track (16) in a first component (11) for effecting a relative displacement between the first component (11) and the second component (21) which results in a transportation displacement of the transportation wheel (32); a displacing member (31) having one end region (39) thereof, which is adjacent to the head (22), supporting the rotary axle (D) together with the transportation wheel (32) and having another end region (38) thereof supporting the at least one actuation member (35); and guide means providing for displacement of the displacing member (31) over the second component (21), wherein the guide means comprises at least one first guide curve (26) and at least one second guide curve (27) provided on the second component (21), a first control pin (36) provided on the displacing member (31) and displaceable along the first guide curve (26) for converting a relative movement between the first component (11) and the second component (21) into a relative movement between the displacing member (31) and the second component (21), and a second control pin (37) provided on the displacing member (31) and displaceable along the second guide curve (27) for converting a relative movement between the displacing member (31) and the second component (21) into a transportation displacement of the transportation wheel (32).

2. A fastening element feeding device according to 1, wherein the first control pin (36) is formed coaxially with the actuation member (35), and the second control pin (37) lies concentrically with the rotary axle (D) of the transportation wheel (32).

3. A fastening element feeding device according to claim 1, wherein the first guide curve (26) has a curvature that curves away from the operational axis (A) between first and second ends (61) thereof adjacent to and remote from the operational axis (A), and the second guide curve (27) has a curvature that curves toward the operational axis (A) between first and second ends (71, 72) thereof remote from and adjacent to the operational axis.

4. A fastening element feeding device according to claim 1, wherein the transportation wheel (32) has two, spaced from each other along the rotary axle (D), ratchet discs (33, 34), and the device further comprises two ratchet mechanisms (43, 44) associated with respective ratchet discs (33, 34).

5. A fastening element feeding device according to claim 4, further comprising return means (40) associated with the first ratchet disc (33), and wherein the first ratchet mechanism (43) is located between the return means (40) and the first ratchet disc (33), and wherein the device further comprises control means for controlling the return means (40) so that rolling of the transportation wheel (32) over the magazine strip (50) is possible only in a return direction of the transportation device (30).

6. A fastening element feeding device according to claim 5, wherein the control means comprises at least one control curve (28) provided on the second component (21) and at least one control member (48) arranged on a control plate (47) and displaceable in the control curve (28) and wherein the first ratchet mechanism (43) comprises spring means (45) secured on the control plate (47).

7. A fastening element feeding device according to claim 1, wherein the first and second guide curves (26, 27) are spaced from each other in a direction of an operational axis (A) defined by the drive-in channel (12), and have a first end (61, 72) adjacent to the operational axis (A), and a second end (62, 71) remote from the operational axis (A), and wherein the first control pin (36) is located at the first end (61) of the first guide curve (26) and the second control pin (27) is located at the first end of the second guide curve (27) in an initial position of the fastening element feeding device.

* * * * *